US007602126B2

(12) United States Patent
Fuse et al.

(10) Patent No.: US 7,602,126 B2
(45) Date of Patent: Oct. 13, 2009

(54) FLASH DISCHARGE LAMP

(75) Inventors: Tetsuo Fuse, Himeji (JP); Katsumi Shojo, Himeji (JP); Takayuki Hiraishi, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 385 days.

(21) Appl. No.: 11/749,273

(22) Filed: May 16, 2007

(65) Prior Publication Data

US 2007/0267974 A1 Nov. 22, 2007

(30) Foreign Application Priority Data

May 16, 2006 (JP) ..... 2006-136240

(51) Int. Cl.
*H01J 17/44* (2006.01)

(52) U.S. Cl. ..... 313/594; 313/607; 313/234

(58) Field of Classification Search ..... 313/234, 313/594, 607, 627–643
See application file for complete search history.

(56) References Cited

U.S. PATENT DOCUMENTS 6,960,883 B2 11/2005 Mizoziri et al.

FOREIGN PATENT DOCUMENTS

| | | | |
|---|---|---|---|
| GB | 671 384 | A | 5/1952 |
| JP | 2003-338265 | A | 11/2003 |
| JP | 2004-22456 | A | 1/2004 |

OTHER PUBLICATIONS

European Search Report for Application No. EP 07 00 9623, Jun. 22, 2009.

*Primary Examiner*—Karabi Guharay
*Assistant Examiner*—Brenitra M Lee
(74) *Attorney, Agent, or Firm*—David S. Safran; Roberts Mlotkowski Safran & Cole, P.C.

(57) ABSTRACT

Flash discharge lamp having an arc tube in which there is a pair of opposed electrodes, a rod-shaped trigger electrode which runs along the outside surface of the arc tube in its lengthwise direction; and a sealed tubular body which jackets the trigger electrode and has a hermetically sealed arrangement containing a metal foil. The trigger electrode has a recessed part on its surface in the vicinity of the metal foil and the recessed part is at least partially filled with the material of which the sealed tubular body is formed.

10 Claims, 7 Drawing Sheets

FLASH DISCHARGE LAMP

BACKGROUND OF THE INVENTION

1. Field of the Invention

The invention relates to a flash discharge lamp which is used, for example, for heat treatment of semiconductor substrates and liquid crystal substrates and for similar purposes. The invention relates especially to a flash discharge lamp in which the outside surface of the arc tube is provided with a trigger electrode.

2. Description of Related Art

Conventionally, a flash discharge lamp is common in which the outside of the arc tube in which a pair of opposed electrodes is arranged is provided with a trigger electrode.

Furthermore, a lamp is known in which, within a sealed tubular body of silica glass, a trigger electrode is sealed and in which this sealed tubular body is located along the arc tube of the flash discharge lamp (hereinafter also called "lamp").

This technology is described in Japanese Patent Application JP-A-2003-203606 and corresponding U.S. Pat. No. 6,960,883.

A conventional flash discharge lamp is described below using FIG. 7. FIG. 8 is an enlarged cross section for describing the hermetically sealed arrangement of the sealed tubular body as shown in FIG. 7. In this flash discharge lamp, within the tubular arc tube 2 of silica glass, there is a pair of electrodes 1. On the outside of the arc tube 2 of this lamp, there is a trigger electrode 3 which is a metallic tungsten rod.

The trigger electrode 3 is located within a sealed tubular body 4 formed of a cylindrical silica glass tube the ends of which are sealed. One end 31 of the trigger electrode 3 is connected to a metal foil 33, a lead 34 which projects from the sealed tubular body 4 is connected to its other end. By hermetic pinch sealing of the sealed tubular body 4 in the region of the metal foil 33, the trigger electrode 3 is held sealed within the sealed tubular body 4. The inside of the sealed tubular body 4 is filled with inert gas and is subjected to a vacuum atmosphere. Thus, oxidation of the trigger electrode 3 is prevented.

The sealed tubular body 4 and the arc tube 2 are attached to one another by a nickel attachment component 5. The attachment component is not shown in FIG. 8.

One end 31 of the trigger electrode 3 is attached to the sealed tubular body 4 by hermetic pinch sealing of the sealed tubular body 4. The other end 32 of the trigger electrode 3 is the free end within the sealed tubular body 4. In this arrangement, even when the trigger electrode 3 expands by receiving light from the lamp, the amount of this expansion can be absorbed by the gap between the other end 32 and the inner wall of the sealed tubular body 4.

By this arrangement in which the trigger electrode 3 is held sealed within the sealed tubular body 4, oxidation of the trigger electrode 3 or deposition of the material comprising the trigger electrode 3 on the arc tube 2 in the case of sputtering of the trigger electrode 3 at a high temperature can be prevented. As a result, formation of cracks in the arc tube 2 can also be prevented.

However, it is required of this flash discharge lamp that a semiconductor substrate (as the article to be treated) is irradiated with light with greater than or equal to 20 J/cm$^2$ energy within the short time of 1 msec. To achieve this, the peak energy with which the flash discharge lamp is supplied is up to $5\times10^6$ W.

Therefore, since the light emitted from the lamp has high energy, the trigger electrode 3 instantaneously reaches a high temperature, expands and afterwards contracts. This means that the trigger electrode 3 often repeats expansion and contraction according to the lamp emission.

As shown in FIG. 8, in the hermetically sealed part of the sealed tubular body 4, as a result of the different coefficients of expansion between the silica glass comprising the sealed tubular body 4 and the tungsten comprising the trigger electrode 3, a very small gap is formed in the vicinity of the trigger electrode 3. Furthermore, as shown in FIG. 8 using the broken line, a region A in which the trigger electrode 3 is welded to the metal foil 33 is repeatedly exposed to tension which forms during expansion and contraction.

Furthermore, when light is emitted from the lamp in the space in the vicinity of the lamp, shock waves are formed. The effect of these shock waves causes the lamp to vibrate, together with this, also the sealed tubular body 4 and the trigger electrode 3 vibrate.

Also, since the trigger electrode 3 and the metal foil 33 are interconnected by resistance heating, the region A to which the metal foil 33 is welded is brittle. That is, in the part A in which the metal foil 33 is welded, the strength of the metal foil is less than the actual strength of the metal foil, if the expansion-contraction stress on the trigger electrode 3 and the effect of the shock waves are repeatedly applied. As a result, the metal foil 33 is shifted into the state (with a separated part) in which it can be in part easily torn.

In this state, if a high frequency high voltage is applied to the trigger electrode 3, in the separated region of the metal foil 33, a discharge is formed by which there is a case in which the trigger output decreases, and as a result, there is no lamp emission. This means that there is a case in which lamp emission takes place, and a case in which there is no lamp emission. Thus, there is the disadvantage that the operating property of the lamp becomes extremely unstable.

Furthermore, for repeated discharges in the torn part of the metal foil 33, finally, the metal foil 33 is completely torn, by which the lamp can no longer be operated at all.

SUMMARY OF THE INVENTION

The invention was devised to eliminate the above described disadvantages in the prior art. Therefore, a primary object of the present invention is to devise a flash discharge lamp in which the flash discharge lamp can supply enough trigger energy and reliable emission can take place.

In a flash discharge lamp which comprises the following:

an arc tube in which there is a pair of opposed electrodes;

a rod-shaped trigger electrode which extends adjacent to the outside surface of the arc tube in its lengthwise direction; and a sealed tubular body which jackets the trigger electrode and a hermetically sealed arrangement with a metal foil is formed on one end, the object is achieved in accordance with the invention in that in the above described trigger electrode in the vicinity of the above described metal foil on the surface a recessed part is formed into which the material comprising the sealed tubular body penetrates.

Furthermore, the object is achieved in accordance with the invention in that a coating layer of metal with a high melting point is formed on the surface of the above described recessed part.

Moreover, the object is achieved in accordance with the invention in that the above described recessed part is formed behind the tip position of the corresponding electrode within the above described arc tube.

ACTION OF THE INVENTION

The flash discharge lamp in accordance with the invention is characterized in that the trigger electrode is held sealed within the sealed tubular body and a recessed part is formed on the surface of the trigger electrode in which the material comprising the sealed tubular body, for example, silica glass, penetrates.

Therefore, even if the trigger electrode is subjected to expansion and contraction, or if vibrations are applied to the trigger electrode, its influence is not applied to the metal foil which is connected to the trigger electrode.

This means that the disadvantage of tearing of the metal foil and similar disadvantages are thus eliminated. As a result, reliable emission of the lamp can take place.

Furthermore, by forming a coating layer of metal with a high melting point on the surface of the recessed part of the trigger electrode, the trigger electrode can be prevented from adhering to the sealed tubular body because an oxide with a high affinity to the material comprising the sealed tubular body is not formed on the surface of the recessed part. As a result, crack formation in the sealed tubular body can be prevented.

Additionally, it is desired that the concave part of the trigger electrode be placed behind the tip position of the corresponding electrode within the arc tube. The reason for this is that, even if the vicinity of the metal foil of the trigger electrode is not irradiated with the radiant light of the lamp, or even if it is irradiated therewith, there is hardly any effect on the expansion and contraction of the trigger electrode since the light output is reduced. As a result destruction of the metal foil can be prevented.

The invention is further described below using several embodiments shown in the drawings.

DETAILED DESCRIPTION OF THE INVENTION

Figure 1:
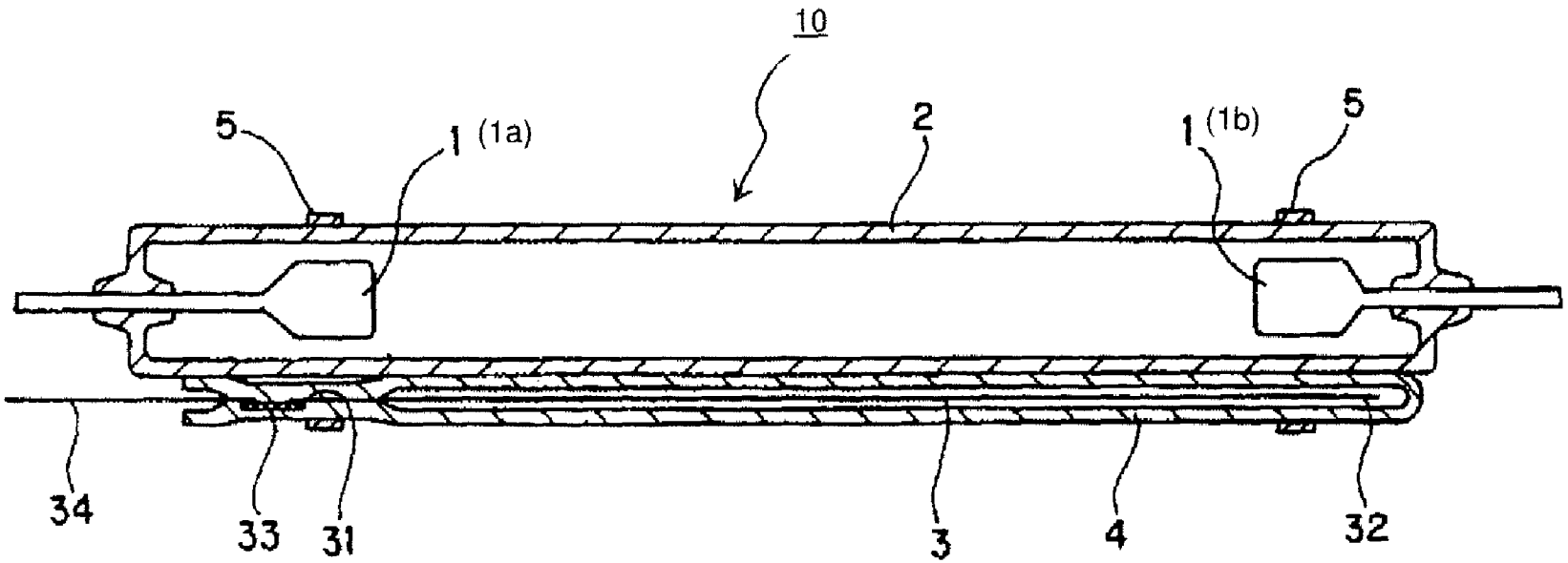
FIG. 1 is a schematic longitudinal cross-sectional view of the flash discharge lamp in accordance with the invention.
Figure 2:
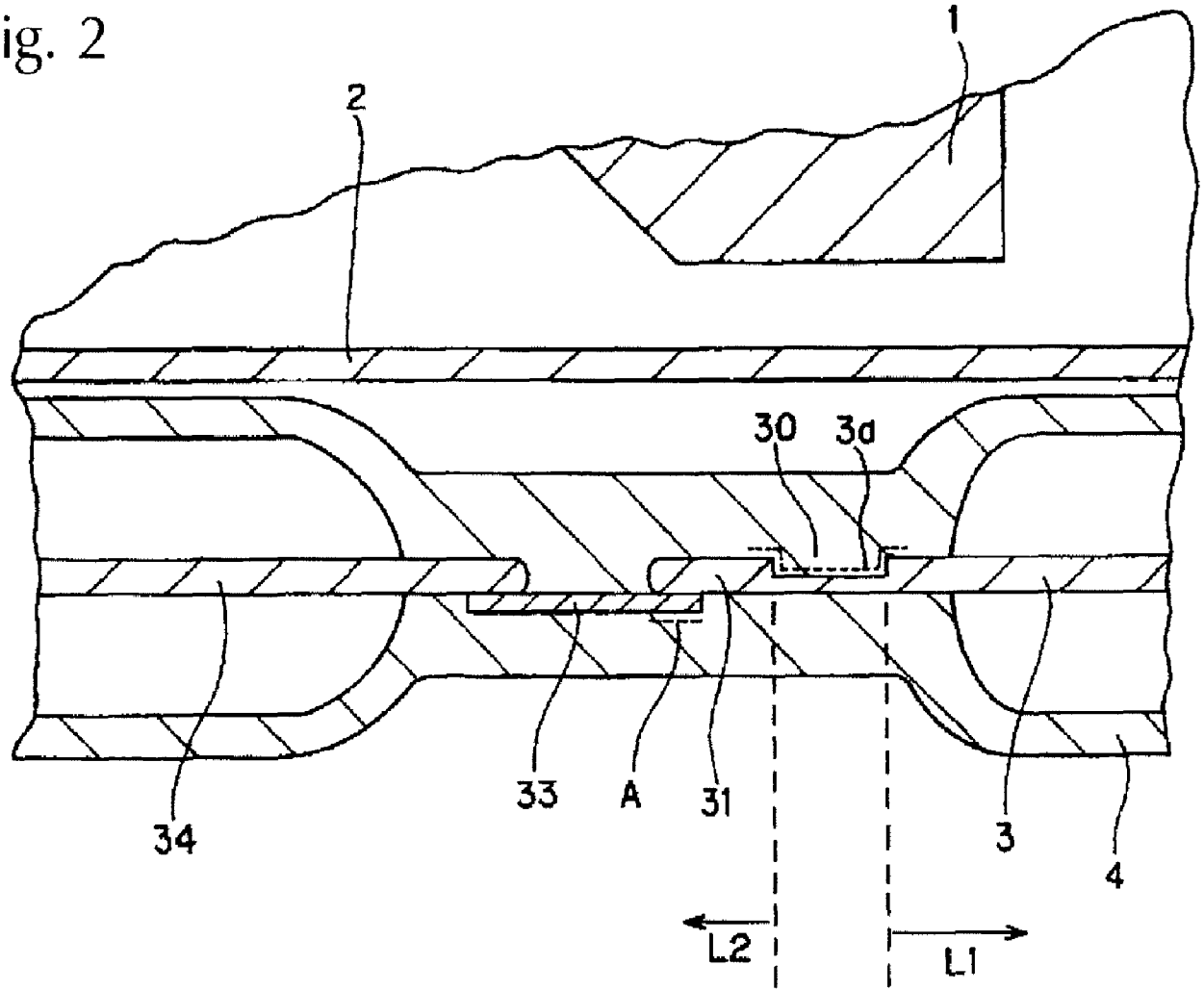
FIG. 2 is an enlarged schematic illustration of the hermetically sealed arrangement of the sealed tubular body as shown in FIG. 1.

The overall arrangement of the flash discharge lamp 10 in accordance with the invention is shown in FIG. 1. FIG. 2 shows an enlarged view of the region with the sealed arrangement of the sealed tubular body 4.

The lamp 10 comprises an arc tube 2, a trigger electrode 3 and a sealed tubular body 4. The arc tube 2 is formed, for example, of silica glass and is tubular. Within the arc tube 2, there is a pair of opposed electrodes 1 (1*a*, 1*b*). The trigger electrode 3 extends in the lengthwise direction of the arc tube 2 on the outside of the arc tube 2. The trigger electrode 3 is arranged such that it is jacketed by the sealed tubular body 4.

The arc tube 2 is, for example, filled with xenon gas. Its two ends are sealed. A discharge space is formed within the arc tube 2. The electrodes 1 (1*a*, 1*b*), in the case of operation using an alternating current, as is shown in the drawings, have the same shape and the same size. However, in the case of operation using a direct current, the two electrodes have different shapes and dimensions, since one of the electrodes is the cathode and the other electrode is the anode. Sintered electrodes are used as the electrodes; their main component is, for example, tungsten. The ends of the electrodes (1*a*, 1*b*) to which a feed device (not shown) is connected project to the outside through the arc tube 2.

Numerical values of the flash discharge lamp are described below using one example.

The inside diameter of the arc tube 2 is selected to be in the range from 8 mm to 15 mm and is, for example, 10 mm. The length of the arc tube 2 is, for example, 300 mm.

The amount of xenon gas added as the main emission component is selected to be in the range from 200 torr to 1500 torr and is, for example, 500 torr. The main emission component is limited not only to xenon gas, but also argon or krypton gas can be used instead. Furthermore, in addition to xenon gas, substances such as mercury and the like can be added.

In the electrode 1, the outside diameter is chosen to be in the range from 4 mm to 10 mm, and is, for example, 5 mm. Its length is chosen to be in the range from 5 mm to 9 mm and is, for example, 7 mm. The distance between the electrodes is selected to be in the range from 160 mm to 500 mm and is, for example, 280 mm. Furthermore, there are also cases in which barium oxide (BaO), calcium oxide (CaO), strontium oxide (SrO), aluminum oxide ($Al_2O_3$), molybdenum or the like is added as an emitter.

The trigger electrode 3 is made of a metallic bar, for example, of tungsten with an outside diameter of 1.5 mm and a length of 500 mm. Besides tungsten, metals such as nickel, aluminum, platinum, inconel (nickel-chromium-iron alloy), molybdenum or the like can be used as the trigger electrode 3.

In the trigger electrode 3, as is shown in FIG. 2, a recessed part 30 is formed which is located behind the tip position of the nearer electrode 1 on the corresponding side of the lamp 10, i.e., at the position in the direction relative to the end of the sealed tubular body 4. This means that the recessed part 30 is not present in a position between the electrodes of the lamp 10, but is located behind the respective electrode. This prevents the recessed part 30 from being irradiated directly by the light produced by the lamp.

This recessed part 30 is formed, for example, by a cutting device. The numerical values are shown below as an example.

The depth is at least 0.2 mm, specifically, 0.3 mm; and the length is at least 1.5 mm, specifically, 4 mm.

On the surface of the recessed part 30, a coating layer 3*a* of metal with a high melting point is formed which must be formed at least on the outer surface of the recessed part 30. However, it can also cover the outer surface of the recessed part 30 and also extend into the area beyond its outer edges as represented in FIG. 2. The coating layer 3*a* is formed of, for example, rhodium or rhenium.

The trigger electrode 3 is located within the cylindrical sealed tubular body 4 with one end closed and the other end sealed. The sealed tubular body 4 made, for example, of silica glass and is formed, for example, in the shape of a cylinder with an outside diameter of 5 mm, an inside diameter of 2 mm and a length of 600 mm.

One end 31 of the trigger electrode 31 is connected to a molybdenum metal foil 33, while a molybdenum terminal 34 is connected to the other end of the metal foil 33 such that it projects from the sealed tubular body 4. A hermetically sealed arrangement is formed about the metal foil 33. In the region surrounding the metal foil 33, the hermetically sealed arrangement is formed by melting of the sealed tubular body 4.

Specifically, the sealed tubular body 4 is shifted into the molten state by, for example, using a burner to heat the tubular body in the region surrounding the metal foil 33 which is to be sealed. The molten material of which the sealed tubular body 4 is formed, for example, silica glass, penetrates into the recessed part 30. Afterwards, the sealed tubular body 4 continues to be heated at a high temperature in the region of the metal foil, by which the metal foil 33 is clamped as a hermetically sealed arrangement is formed.

In this hermetically sealed arrangement, the trigger electrode 3 is prevented from being attached to the silica glass and crack formation in the sealed tubular body 4 can be prevented. The reason for this is the following:

On the surface of the recessed part 30, the coating layer 3*a* of a metal with a high melting point is formed. Therefore, an oxide with a high affinity to silica glass cannot be produced on the surface of the trigger electrode 3.

The inside of the sealed tubular body 4 is filled with an inert gas or is subjected to a vacuum atmosphere. Therefore, oxidation of the trigger electrode can be prevented. The sealed tubular body 4 and the arc tube 2 are attached to one another by means of an attachment component 5 of, for example, nickel, which is not shown in FIG. 2.

However, since one end 31 of the trigger electrode 3 is attached to the sealed tubular body 4 and the other end 32 within the sealed tubular body 4 is a free end, there is an arrangement in which, even if the trigger electrode 3 is heated and expanded when receiving radiant light from the lamp, the amount of this expansion can be absorbed by the gap between the other end 32 and the inner wall of the sealed tubular body 4.

Silica glass as the material of the sealed tubular body 4 penetrates into the recessed part 30 of the trigger electrode 3 and solidifies. In this connection, the side of the trigger electrode 3 which lies within the sealed tubular body 4 is called the main part L1 and the sealed side is called the base part L2.

In this connection, if the trigger electrode 3 is irradiated with radiant light according to the emission of the lamp 10, the main part L1 of the trigger electrode 3 expands and contracts. However, the expansion-contraction stress only influences the silica glass which has flowed into the recessed part 30 and not onto the base part L2 of the trigger electrode 3.

Since the recessed part 30 is formed behind the tip position of the electrode 1, the base part L2 of the trigger electrode 3 is not irradiated with the radiant light of the lamp, or even upon irradiation, the action of the light is low. Therefore, there is hardly any expansion and contraction in the base part L2.

As a result, even upon irradiation of the trigger electrode 3 with radiant light in the course of emission of the flash discharge lamp, the region A in which the metal foil 33 is welded to the trigger electrode 3 is not exposed to stress. Thus, the disadvantage of tearing of the metal foil 33 is eliminated.

Even if shock waves form in the course of emission of the flash discharge lamp in the space in the vicinity of the lamp, and the trigger electrode 3 vibrates in the sealed tubular body 4, this vibration acts only on the main part L1 and not on the base part L2. As a result, the metal foil 33 is not exposed to vibration even if the trigger electrode 3 vibrates. Thus, the disadvantage of tearing of the metal foil 33 is eliminated.

As was described above, in the flash discharge lamp in accordance with the invention, the region A in which the trigger electrode 3 is welded to the metal foil 33 is not exposed to the effect of expansion and contraction or vibration of the trigger electrode 3. The disadvantage of tearing of the metal foil 33 and similar disadvantages therefore do not occur. A high frequency high voltage can reliably be applied to the trigger electrode 3 via the metal foil 33.

The shape of the recessed part 30 which has been formed in the trigger electrode 3 is described below.

Figure 3:
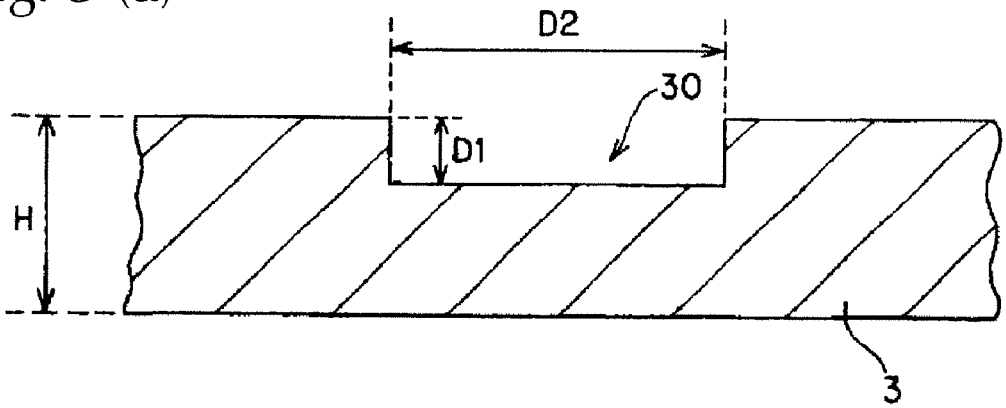
FIGS. 3(*a*) & 3(*b*) are schematic sectional and perspective views, respectively, of a metallic rod used as a trigger electrode for supplying a high voltage to a flash discharge lamp in accordance with the invention.
Figure 3:
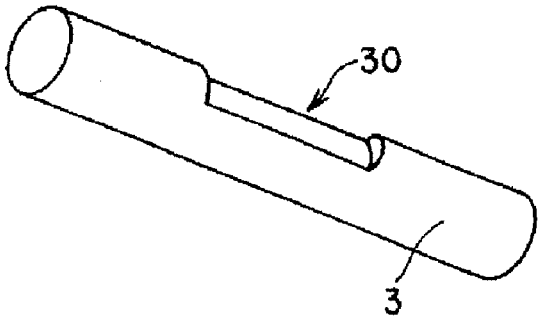

FIGS. 3(*a*) & 3(*b*) are enlarged views of the recessed part 30 of the trigger electrode 3. FIG. 3(*a*) is a side view of the trigger electrode. FIG. 3(*b*) is a perspective of the trigger electrode. The depth D1 (mm) of the recessed part 30 is advantageously in the range of $0.2 \leqq D1 \leqq \frac{1}{2} H$ where H is the outside diameter of the trigger electrode 3. The reason for this is the following:

When the depth D1 of the recessed part 30 is less than 0.2 (mm), the silica glass in the molten state does not penetrate into the recessed part 30 in the process of sealing. When the depth D1 exceeds ½ H, the strength of the trigger electrode 3 decreases. Thus, the possibility of damaging the trigger electrode 3 by breaking or the like increases.

It is advantageous that the length D2 (mm) of the recessed part 30 is in the range from 1.5 mm to 20 mm. The reason for this is the following:

When the length D2 is less than 1.5 (mm), the silica glass in the molten state does not penetrate into the recessed part 30 in the process of sealing. The value of the upper limit of the length D2 of the concave part 30 is not especially limited. However, when it exceeds 20 (mm), the disadvantage of breaking of the trigger electrode 3 as a result of a reduction of its strength and similar disadvantages occur.

The recessed part 30 of the trigger electrode 3 is described below using other embodiments. In this connection, only the trigger electrode 3 is shown, and neither the sealed tubular body nor the metal foil are further described.

Figure 4:
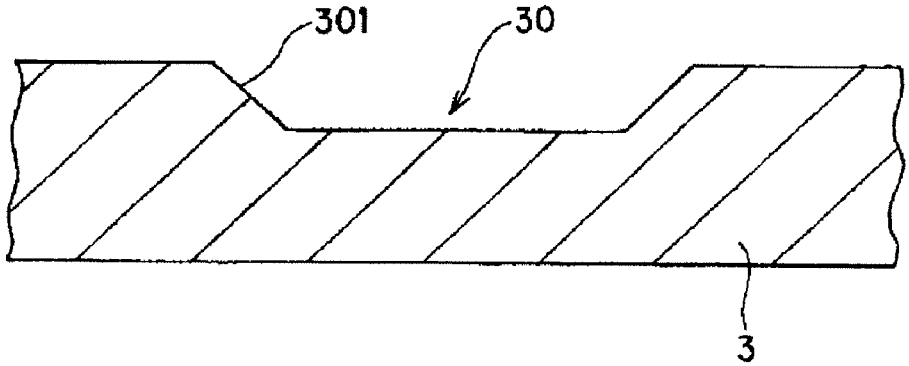
FIG. 4 is a sectional view similar to that of FIG. 3(*a*) but showing another embodiment of the metallic rod used as a trigger electrode for supplying a high voltage to a flash discharge lamp in accordance with the invention.

FIG. 4 shows an arrangement in which the recessed part 30 is bounded by an obliquely angled plane 301 which yields the advantage that, when the silica glass of the sealed tubular body melts, this silica glass can easily penetrate into the recessed part 30 along the angled plane 301.

Figure 5:
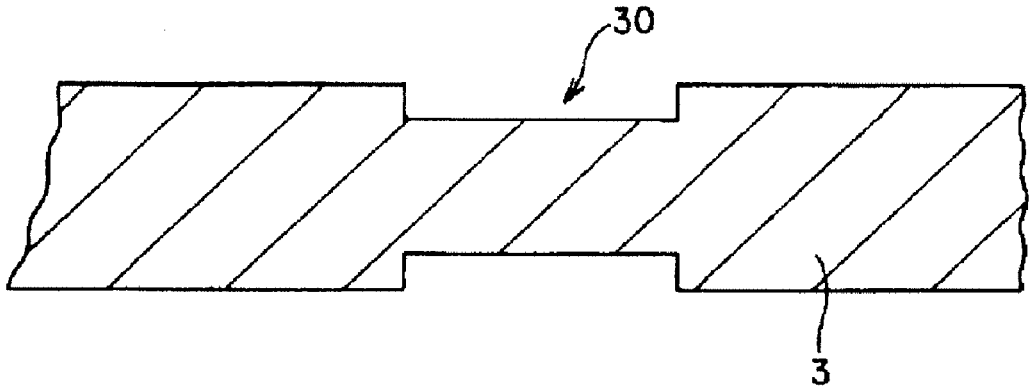
FIGS. 5(*a*) & 5(*b*) are schematic sectional and perspective views, respectively, of another embodiment of the metallic rod used as a trigger electrode for supplying a high voltage to a flash discharge lamp in accordance with the invention.
Figure 5:
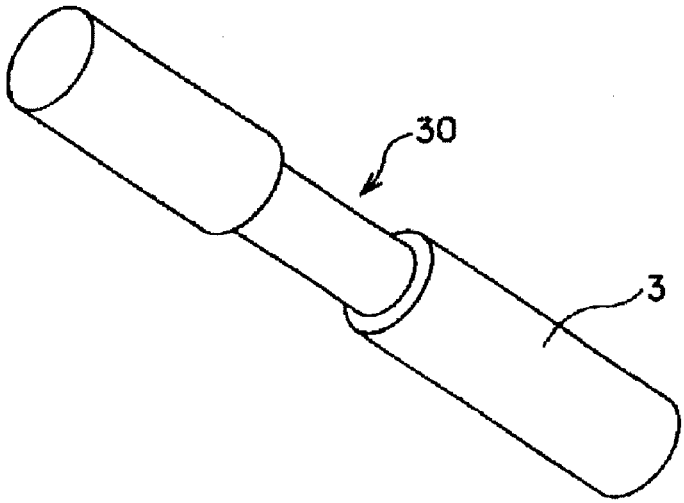

FIGS. 5(*a*) & 5(*b*) each show an arrangement in which the recessed part 30 is not only formed on part of the periphery of the trigger electrode 3, but is formed around the entire periphery of the trigger electrode 3. FIG. 5(*a*) shows a side cross-sectional view of the trigger electrode 3. FIG. 5(*b*) is a perspective of the entire trigger electrode 3.

Due to this formation of the recessed part 30 in the overall periphery of the trigger electrode 3, the trigger electrode 3 has a region with a large diameter and a region with a small diameter. The molten silica glass penetrates into the overall periphery of the concave part (of the region with a small diameter) of the trigger electrode 3. Thus, an arrangement can be devised in which the trigger electrode 3 is attached more securely.

Figure 6:
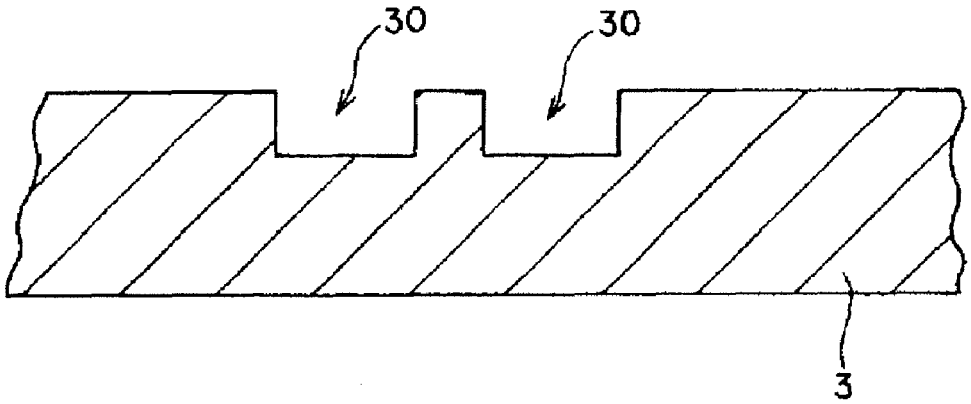
FIGS. 6(*a*) & 6(*b*) each show a schematic sectional view of additional embodiments of the metallic rod used as a trigger electrode for supplying a high voltage to a flash discharge lamp in accordance with the invention.
Figure 6:
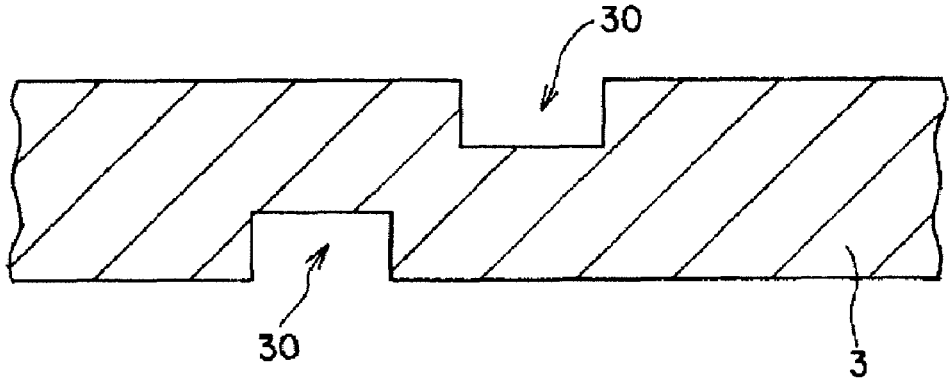
Figure 7:
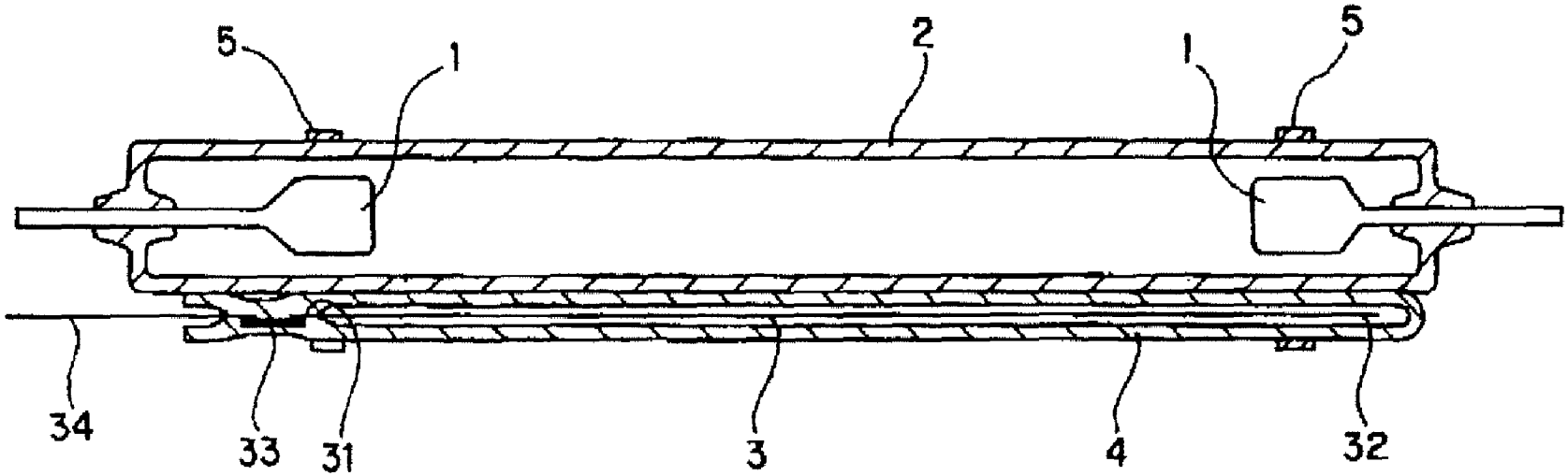
Fig. 7 (Prior Art)
FIG. 7 is a view corresponding to that of FIG. 1, but showing a conventional flash discharge lamp.
Figure 8:
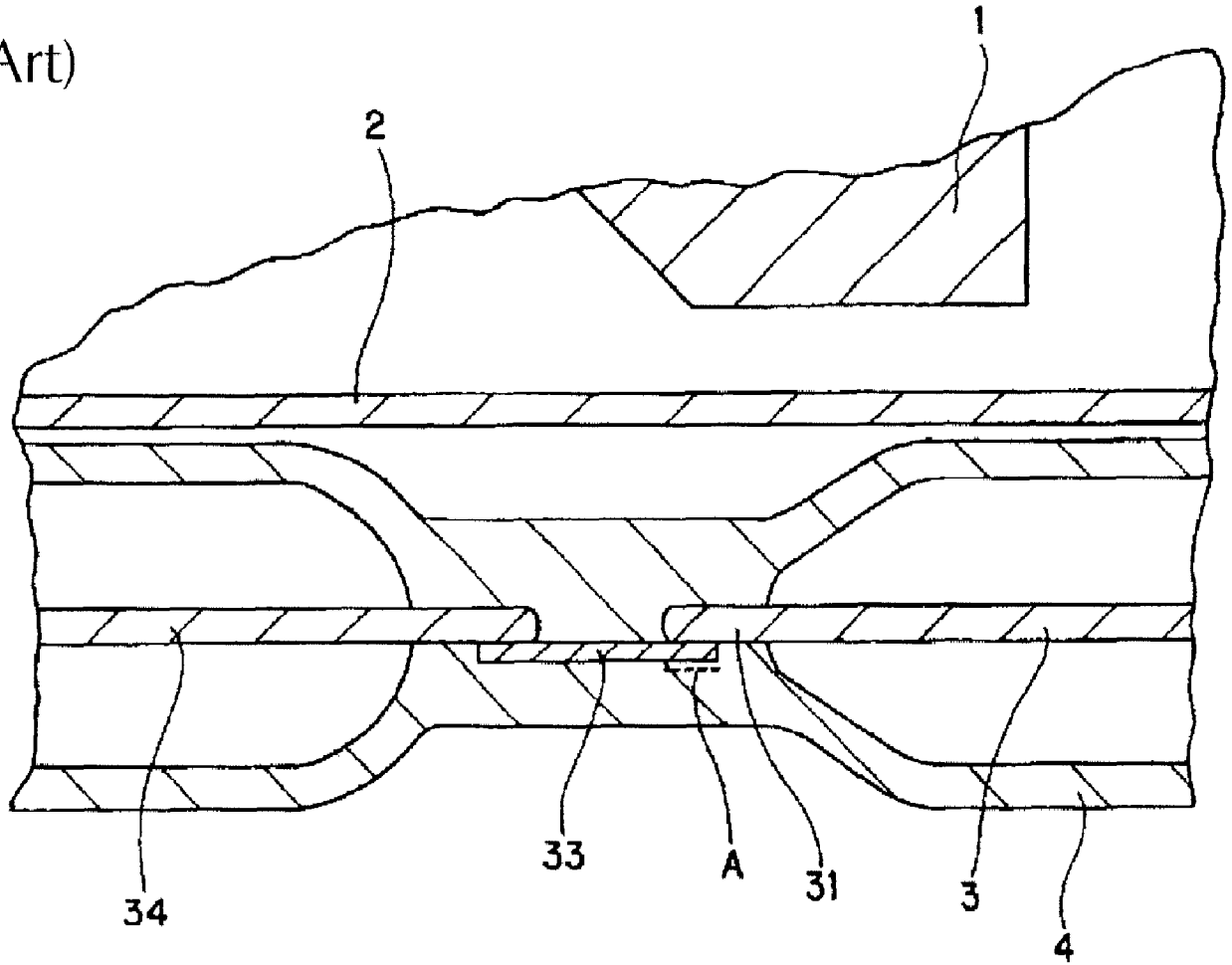
Fig. 8 (Prior Art)
FIG. 8 is a view corresponding to that of FIG. 2, but showing the hermetically sealed arrangement of the sealed tubular body of the conventional flash discharge lamp FIG. 7.

FIGS. 6(*a*) & 6(*b*) each show an arrangement in which there are several recessed parts 30 in the lengthwise direction of the trigger electrode 3. FIG. 6(*a*) shows an arrangement in which several recessed parts 30 are arranged in the same side of the trigger electrode 3. FIG. 6(*b*) shows an arrangement in which the two recessed parts 30 are located on different sides of the trigger electrode 3. The trigger electrode 3 can be reliably attached in the sealed tubular body by these arrangements with several recessed parts 30 arranged in the lengthwise direction of the trigger electrode 3.

What we claim is:

1. Flash discharge lamp, comprising:

an arc tube in which there is a pair of opposed electrodes;

a rod-shaped trigger electrode which runs along an outside surface of the arc tube in a lengthwise direction thereof; and a sealed tubular body which jackets the trigger electrode, the tubular body having a hermetically sealed arrangement on one end thereof in which a metal foil is located, wherein the trigger electrode has a recessed part in proximity to the metal foil and wherein the recessed part is at least partially filled with material of which the sealed tubular body is formed.

2. Flash discharge lamp in accordance with claim 1, wherein a coating layer of metal with a high melting point is formed on at least a surface of the recessed part.

3. Flash discharge lamp in accordance with claim 2, wherein the coating layer is made of rhenium or rhodium.

4. Flash discharge lamp in accordance with claim 1, wherein the recessed part is located in an area of the hermetically sealed arrangement.

5. Flash discharge lamp in accordance with claim 1, wherein the recessed part has a depth D1 (in mm) which satisfies the condition $0.2 \leqq D1 \leqq \frac{1}{2}H$, where H (in mm) is an outside diameter of the trigger electrode.

6. Flash discharge lamp in accordance with claim 1, wherein side walls of the recessed part are obliquely angled.

7. Flash discharge lamp in accordance with claim 1, wherein the recessed part extends peripherally completely around the trigger electrode.

8. Flash discharge lamp in accordance with claim 1, wherein plural recessed parts are formed in succession in the trigger electrode.

9. Flash discharge lamp in accordance with claim 8, wherein the plural recessed parts are on the same side of the trigger electrode.

10. Flash discharge lamp in accordance with claim 8, wherein the plural recessed parts are alternately on opposite sides of the trigger electrode.

* * * * *